United States Patent [19]

Bardenstein

[11] 4,403,724

[45] Sep. 13, 1983

[54] AUTOMATED WALL PANEL FRAME MANUFACTURING APPARATUS

[75] Inventor: Albert Bardenstein, Syracuse, N.Y.

[73] Assignee: Irwin J. Berlin, Venice Center, N.Y.

[21] Appl. No.: 252,414

[22] Filed: Apr. 9, 1981

[51] Int. Cl.[3] ..... B27F 7/02

[52] U.S. Cl. ..... 227/76; 83/435.2; 83/423; 144/245 A; 227/152

[58] Field of Search ..... 83/435.2, 423, 425.2, 83/425.3, 425.4; 144/1, 3, 245 A, 245 R, 242 D; 227/76, 152, 44, 45, 48, 50

[56] References Cited

U.S. PATENT DOCUMENTS

| | | | |
|---|---|---|---|
| 1,968,091 | 7/1934 | Nash | 144/245 A X |
| 2,649,875 | 8/1953 | Sherman | 144/245 A X |
| 3,399,445 | 9/1968 | Carroll | 227/76 X |
| 3,711,007 | 1/1973 | Fry | 227/152 X |
| 3,894,908 | 7/1975 | Troutner et al. | 144/3 R X |
| 4,068,549 | 1/1978 | Huffman | 83/435.2 X |
| 4,133,097 | 1/1979 | Slade | 144/1 R X |
| 4,221,246 | 9/1980 | Grutter | 144/245 R X |

*Primary Examiner*—Paul A. Bell

*Attorney, Agent, or Firm*—Kane, Dalsimer, Kane, Sullivan and Kurucz

[57] ABSTRACT

An apparatus is provided for the automatic manufacture of wall frames. The apparatus includes a pair of guides for receiving top and bottom plates of the frame. A conveyor belt moving between the guides delivers studs between the plates where they are automatically nailed. The studs are carried past a saw which cuts them to the proper length. As the studs are secured to the plates and the frame built up, the conveyor moves the frame along.

4 Claims, 2 Drawing Figures

AUTOMATED WALL PANEL FRAME MANUFACTURING APPARATUS

BACKGROUND OF THE INVENTION

The present invention relates to an apparatus for the automated manufacture of wall frames and in particular to a device for the manufacture of relatively short, non-load carrying frames.

In the construction of building, such as may be used for light industrial or residential housing, there are usually several locations at which a non-load carrying frame must be employed to secure the wallboard or paneling. Such frames, for example, would be used above and below each window opening, about built-in units, and in similar locations.

Heretofore, it has been necessary for a carpenter at the job site to set and cut the plates and studs for each such frame. This is a time consuming operation and, due to its labor extensiveness, relatively expensive to perform. Since in most buildings it is usual for all windows to be set at the same height and are usually of the same design, the under-window frames are basically alike throughout the building. As a result, these portions lend themselves to mass production even though heretofore they have been custom-made.

In view of the above, it is the principal object of the present invention to provide an improved apparatus which produces frames to the type described.

A further object is to provide such an apparatus which operates relatively automatically and requires a minimum amount of manual intervention.

Still another object is to provide such an apparatus which produces such frames at a cost competitive with those manufactured by conventional techniques.

Still other objects and advantages will become apparent from the following description.

SUMMARY OF THE INVENTION

The above and other beneficial objects and advantages are attained in accordance with the present invention by providing a machine for automatically producing small frame units. The machine comprises an elongated framework along which a conveyor moves. The frame includes surfaces for receiving a pair of plates in spaced apart, parallel relationship and for maintaining the plates in such relationship. The conveyor contains a plurality of U-shaped brackets spaced apart from each other center to center by the desired stud positioning (usually 16" centers). The brackets are designed to each freely hold a stud and move it along from one end of the framework toward the opposite end. A saw is secured to the frame along the path of the conveyor with its blade positioned to cut each stud to a length equal to the spacing between the plates. Two pairs of nail guns are positioned along the framework upstream of the saw to nail the opposite ends of each stud to the plates. The conveyor delivers each stud to the saw, removes the sawed stud and delivers it between the plates for nailing. The conveyor then moves the plates and attached studs along the framework thereby building up the desired wall panel frame as additional studs are added between the plates. To this end, the conveyor follows a continuous path from below the plate securing surfaces of the framework to the surfaces and then below the surface again. In this manner, the studs carried by the conveyor are delivered to the plates for nailing and then released after the plates and studs have moved along the frame.

DETAILED DESCRIPTION OF THE PREFERRED EMBODIMENT

Figure 1:
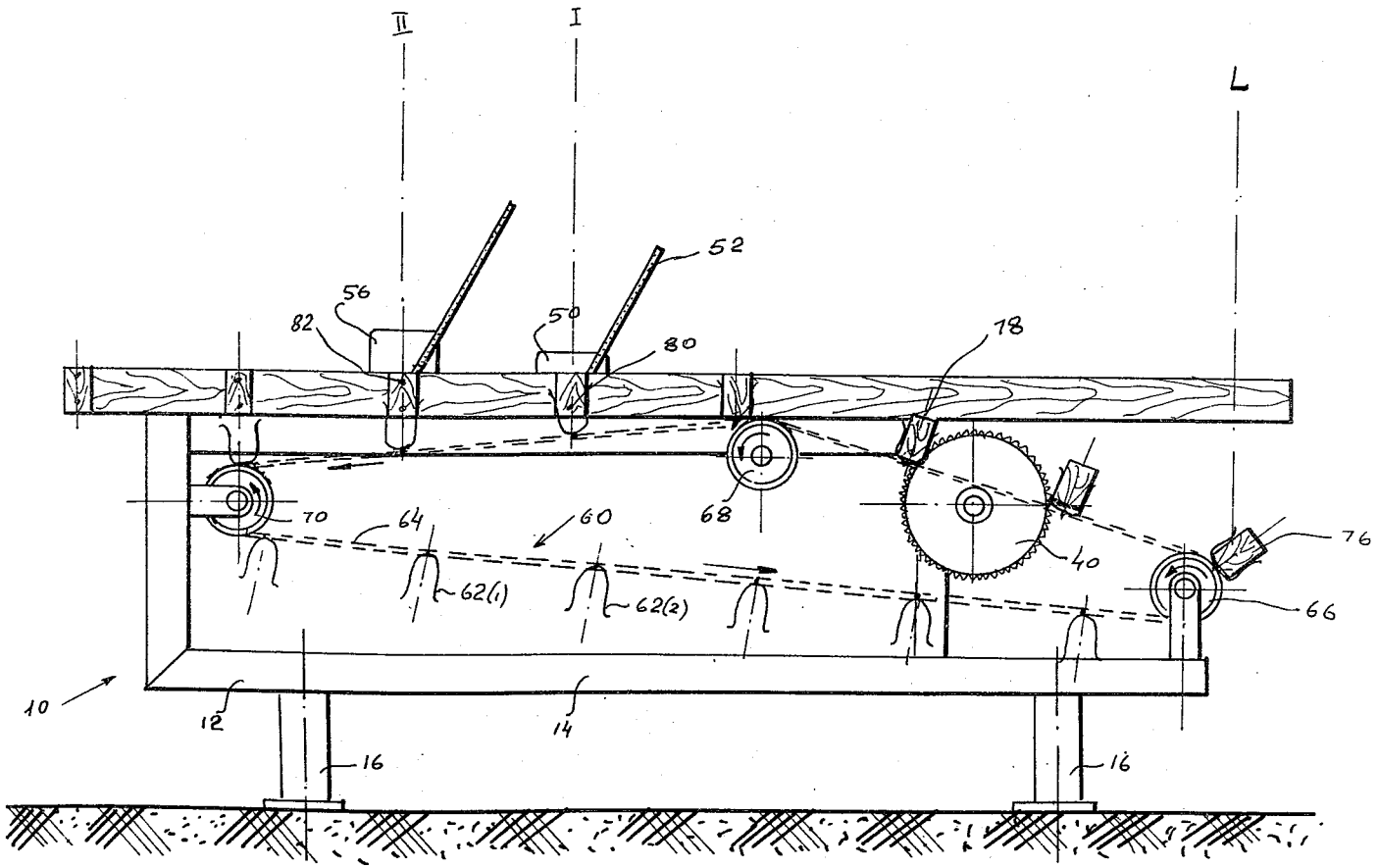
FIG. 1 is a side elevational view of an apparatus in accordance with the present invention; and, FIG. 2 is an elevational view of the apparatus of FIG. 1.
Figure 2:
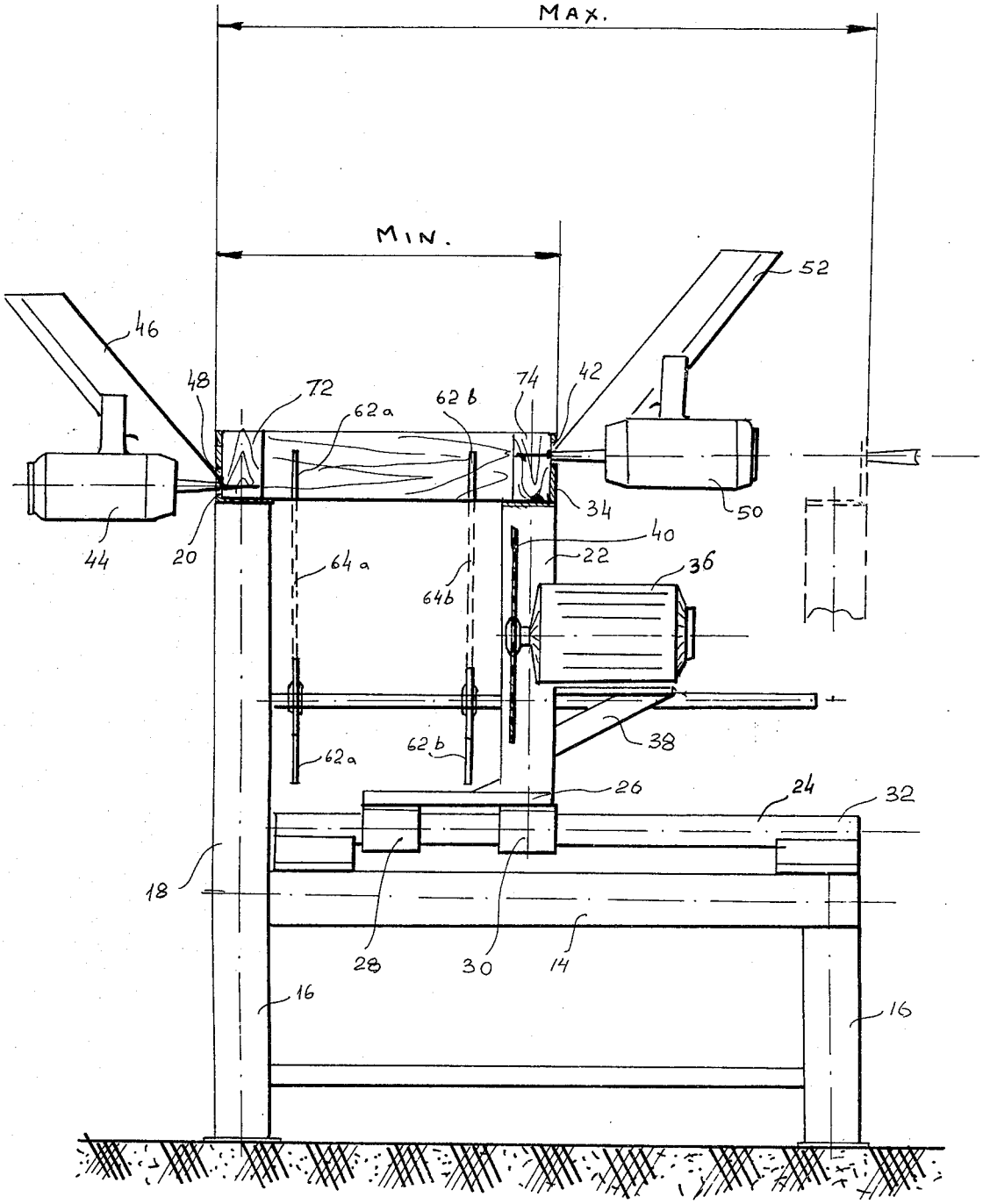

Reference is now made to the drawings and to FIG. 1 in particular wherein an apparatus 10 in accordance with the present invention is shown comprising an elongated framework generally designated 12 consisting of a base 14 supported by legs 16. A pair of uprights 18 extend along one side of the framework. The uprights terminate in a "L" shaped member 20. A second upright 22 is secured to a carriage 24 through a base 26 and collars 28, 30 designed to move along rod 32. An inverted "L"-shaped bracket 34 is secured to the top of upright 22 aligned with bracket 20. Thus, as upright 22 is shifted along carriage 24, the brackets 20, 34 remain aligned with each other but the distance between them varies.

A saw 36 is secured via bracket 38 to upright 22 and designed to move with the upright. The blade 40 of saw 36 is spaced inwardly from the inner surface of the vertical portion 42 of bracket 34 by a distance equal to the width of a plate. Since building studs and plates are conventionally formed of 2×4 lumber, the saw blade 40 is set inwardly from portion 42 a distance equal to nominal 2". First and second pairs of nail guns are provided secured to the framework as follows. A first nail gun 44 is secured to member 46 which in turn is secured to the upright 20 so that the nails pass through an opening in the vertical portion 48 of bracket 20. Nail gun 50 is similarly secured to member 52 which in turn is secured to and moves with upright 22. The nails from nail gun 50 pass through suitable openings in the vertical portion 42 of member 34. A second set of nail guns 56 (only one of which is shown in FIG. 1) is positioned upstream of nail guns 44, 50.

A conveyor generally designated 60, extends along the framework 12 between uprights 18 and 22. The conveyor consists of a plurality of pairs of "U"-shaped brackets 62 secured to a pair of drive chains 64 which travel about pulleys 66, 68, 70. One of the pulleys is driven so that the chain moves in the direction of the arrow.

As stated, the conveyor comprises a pair of chains **64*a*, 64*b* spaced apart from each other with aligned brackets 62*a*, 62*b* being provided on each of the chains. The conveyor travels from pulley 66 which is below the level of the plate supports 20, 34 over pulley 68 to a height substantially equal to that of the plate supports 20, 34 and then over pulley 70 to a height which is once again below that of plate supports 20, 34. The longitudinal spacing between adjacent pairs of U-shaped brackets along the chains (e.g., between the bracket 62(1) and adjacent 62(2) as shown in FIG. 1**) measured center line to center line is the desired distance between studs of the wall frame to be built. In most applications, this distance is 16".

In operation, the height of the desired wall frame is determined and upright 22 is moved so that the distance between the vertical portions 42, 48 of L-shaped brackets 20, 34 is equal to that height. A pair of plates 72, 74 is then positioned in the bend of the L-shaped brackets 20, 34 as shown. Lumber for studs is then fed at the front end of the apparatus (i.e., proximal pulley 66) between the first pair of U-shaped brackets **62*a*, 62*b* of conveyor 60. Lumber is simultaneously fed to each subsequent pair of U-shaped brackets as they are presented at the loading station which is designated "L" in FIG. 1. The stud lumber 76 is carried passed saw blade 40 where, due to the positioning of the blade, it is cut to a size corresponding to the distance between the inner faces of plates 72, 74. The cut lumber 78 is then carried by the conveyor over pulley 68 between plate 72, 74. The first set of nail guns 44, 50 is positioned at the point at which the bottom of stud 78 aligns with the bottom of plate 72, 74 and nail guns 44, 50 are fired at this point (designated I in FIG. 1). As a result of the nails 80 from nail guns 44, 50, stud 78 is secured to plates 72, 74 at location I and as the conveyor continues to move, the plates 72, 74 are carried with stud 78 to the position of the second nail gun 56. This position (indicated by Roman Numeral II) occurs as the conveyor moves downwardly toward pulley 70 a distance sufficient to free the U-shaped brackets of stud 78. The second set of nail guns 56 then fires securing a second nail into each of the plates and the stud 78**. As the conveyor continues the U-shaped brackets free themselves of that stud but due to the next set of brackets and the next stud, the process repeats.

The process continues until a wall frame member of the desired length is formed. This is determined by the length of plates 72, 74. At the far end of the conveyor (i.e., proximal pulley 70) the completed wall frame is then removed ready for installation.

Thus, in accordance with the above, the aforementioned objects are attained.

Having thus described the invention, what is claimed is:

1. An apparatus for manufacturing wall panel frames comprising:

a frame;

means including a top surface of said frame for receiving a first plate;

means including a top surface of said frame for receiving a second plate parallel to and spaced apart from the first plate;

a conveyor extending between said first and second plate receiving means for delivering spaced apart studs between said plates, said conveyor following a continuous path from below said top surface, substantially to said top surface, and then returning below said top surface;

a saw positioned along said conveyor upstream of said first and second plate receiving means for cutting each of the studs delivered by the conveyor to a length equal to the spacing between said plates, said saw being upstream of where said conveyor reaches said top surface;

an automatic nailing device secured to said frame along said conveyor downstream of where the conveyor reaches the top surface and adapted to nail said studs to said plates when said studs are properly positioned between said plates; and, releasable stud engaging means on said conveyor, said stud engaging means being adapted to release after a stud has passed said nailing device whereby said conveyor also moves said plates and the attached studs.

2. The apparatus in accordance with claim 1 wherein said plate receiving means are movable transversely with respect to each other.

3. The apparatus in accordance with claim 1 wherein said plate receiving means are movable transversely with respect to each other and said saw moves with one of said receiving means.

4. The invention in accordance with claim 1 wherein said conveyor comprises a plurality of spaced apart "U" shaped brackets mounted to a continuous chain, each of said brackets being dimensioned to freely hold within the web of the "U" a stud.

* * * * *